US008610647B2

(12) United States Patent
Yamashita et al.

(10) Patent No.: US 8,610,647 B2
(45) Date of Patent: Dec. 17, 2013

(54) IMAGE DISPLAY APPARATUS AND METHOD OF DRIVING THE IMAGE DISPLAY APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 712 days.

(21) Appl. No.: 12/585,920

(22) Filed: Sep. 29, 2009

(65) Prior Publication Data

US 2010/0103162 A1 Apr. 29, 2010

(30) Foreign Application Priority Data

Oct. 29, 2008 (JP) ..... P2008-277899

(51) Int. Cl.
*G09G 3/30* (2006.01)

(52) U.S. Cl.
USPC ..... 345/77; 345/76; 345/204; 345/211; 345/213; 345/214

(58) Field of Classification Search
None
See application file for complete search history.

(56) References Cited

U.S. PATENT DOCUMENTS

2007/0268210 A1 11/2007 Uchino et al.
2008/0030436 A1 * 2/2008 Iida et al. ..... 345/77

FOREIGN PATENT DOCUMENTS

| | | | |
|---|---|---|---|
| JP | 2006-053236 | A | 2/2006 |
| JP | 2007-133284 | | 5/2007 |
| JP | 2007-310311 | | 11/2007 |
| JP | 2007-316454 | A | 12/2007 |
| JP | 2008-122497 | A | 5/2008 |
| JP | 2008-146093 | A | 6/2008 |
| JP | 2008-233122 | A | 10/2008 |
| JP | 2008-257086 | A | 10/2008 |

OTHER PUBLICATIONS

Japanese Office Action issued Apr. 19, 2011 for corresponding Japanese Application No. 2008-277899.
Japanese Office Action issued Dec. 14, 2010 for corresponding Japanese Application No. 2008-277899.

* cited by examiner

*Primary Examiner* — Joseph Haley
*Assistant Examiner* — Ifedayo Iluyomade
(74) *Attorney, Agent, or Firm* — Rader, Fishman & Grauer PLLC

(57) ABSTRACT

The present invention retains a scanning line for power supply in a floating state in a pause provided halfway through a period of emission.

12 Claims, 8 Drawing Sheets

IMAGE DISPLAY APPARATUS AND METHOD OF DRIVING THE IMAGE DISPLAY APPARATUS

BACKGROUND OF THE INVENTION

1. Field of the Invention

The present invention relates to an image display apparatus and a method of driving an image display apparatus and can be applied to, for example, an active matrix image display apparatus using organic EL (Electro Luminescence) devices. According to the present invention, deterioration of image quality can effectively be avoided in a configuration in which a pause is provided halfway through a period of emission by retaining a scanning line for power supply in a floating state in the pause provided halfway through the period of emission.

2. Description of the Related Art

In recent years, active matrix image display apparatuses using organic EL devices have actively been developed. Here, an organic EL device can be driven with an applied voltage of 10 [V] or less. Thus, this type of image display apparatus can reduce power consumption. Moreover, an organic EL device is a self-luminous device. Therefore, this type of image display apparatus does not need a backlight apparatus so that the image display apparatus can be made lighter and thinner. Further, the organic EL device is characterized by a quick response speed of about several μsec. Therefore, this type of image display apparatus is characterized in that an afterimage rarely persists during display of moving images.

More specifically, in an active matrix image display apparatus using organic EL devices, pixel circuits including organic EL devices and driving circuits driving organic EL devices are arranged in a matrix form to form a display unit. This type of image display apparatus displays a desired image by driving each pixel circuit by a signal line driving circuit and a scanning line driving circuit arranged around the perimeter of the display unit via a signal line and a scanning line, respectively, provided in the display unit.

As to an image display apparatus using the organic EL device, Japanese Patent Application Laid-Open No. 2007-310311 discloses a configuration in which two transistors are used to form a pixel circuit to prevent fluctuations in threshold voltage of driving transistors that drive the organic EL device and quality deterioration due to fluctuations in mobility.

Here, FIG. 6 is a block diagram showing an image display apparatus disclosed by Japanese Patent Application Laid-Open No. 2007-310311. This image display apparatus 1 is an image display apparatus using organic EL devices and a display unit 2 is created on an insulating substrate such as glass. The image display apparatus 1 has a signal line driving circuit 3 and a scanning line driving circuit 4 created around the perimeter of the display unit 2.

Here, the signal line driving circuit 3 outputs a driving signal Ssig for signal line to a signal line DTL provided in the display unit 2. More specifically, after image data D1 input in order of raster scanning is latched sequentially and distributed to the signal line DTL by a horizontal selector (HSEL) 3A, the signal line driving circuit 3 performs digital/analog conversion processing on each image data D1. The signal line driving circuit 3 processes a digital/analog conversion result to generate the driving signal Ssig. The image display apparatus 1 thereby sets a gradation of each pixel circuit 5 in accordance with, for example, a so-called line sequence.

The scanning line driving circuit 4 outputs a write signal WS and a driving signal DS to a scanning line WSL for write signal and a scanning line DSL for power supply provided in the display unit 2, respectively. Here, the write signal WS is a signal to exercise ON/OFF control of a write transistor provided in each pixel circuit 5. The driving signal DS is a signal to control the drain voltage of a driving transistor provided in each pixel circuit 5. The scanning line driving circuit 4 processes predetermined sampling pulses SP at a clock CK in a write scan circuit (WSCN) 4A and a drive scan circuit (DSCN) 4B to output the write signal WS and the driving signal DS, respectively.

The display unit 2 is formed by arranging the pixel circuits 5 in a matrix form. The display unit 2 has color filters of red, green and blue provided sequentially cyclically in each pixel circuit 5 and accordingly, pixels of red, green, and blue are sequentially created.

Here, in the pixel circuit 5, the cathode of an organic EL device 8 is connected to a predetermined cathode power supply Vcath and the anode of the organic EL device 8 is connected to the source of a driving transistor Tr2. The driving transistor Tr2 is, for example, an N-channel type transistor of TFT. In the pixel circuit 5, the drain of the driving transistor Tr2 is connected to the scanning line DSL for power supply and the driving signal DS for power supply is supplied to the scanning line DSL from the scanning line driving circuit 4. Accordingly, the pixel circuit 5 drives by current the organic EL device 8 using the driving transistor Tr2 in a source follower circuit configuration.

The pixel circuit 5 has a holding capacity Cs provided between the gate and source of the driving transistor Tr2 and a gate-side voltage of the holding capacity Cs is set to the voltage of the driving signal Ssig by the write signal WS. As a result, the pixel circuit 5 drives by current the organic EL device 8 using the driving transistor Tr2 by a gate-source voltage Vgs in accordance with the driving signal Ssig. Here, in FIG. 6, a capacity Ce1 is a stray capacitance of the organic EL device 8. It is assumed below that the capacity Ce1 is sufficiently larger than the holding capacity Cs and the parasitic capacitance of the gate node of the driving transistor Tr2 is sufficiently smaller than the holding capacity Cs.

That is, in the pixel circuit 5, the gate of the driving transistor Tr2 is connected to the signal line DTL via a write transistor Tr1 switched ON/OFF by the write signal WS. Here, the write transistor Tr1 is, for example, an N-channel type transistor of TFT.

Here, the signal line driving circuit 3 outputs the driving signal Ssig by switching, at a predetermined timing, a gradation setting voltage Vsig and a voltage Vofs for threshold voltage correction. The fixed voltage Vofs for threshold voltage correction is a fixed voltage used for correcting fluctuation of the threshold voltage of the driving transistor Tr2. The gradation setting voltage Vsig is a voltage specifying the luminance of emission of the organic EL device 8 and is obtained by adding the fixed voltage Vofs for threshold voltage correction to a gradation voltage Vin. The gradation voltage Vin is a voltage corresponding to the luminance of emission of the organic EL device 8. The gradation voltage Vin is generated for each signal line DTL by, after the image data D1 input in order of raster scanning is latched sequentially and distributed to each signal line DTL by the horizontal selector 3A, performing digital/analog conversion processing on the image data D1.

As shown in FIGS. 7A to 7E, in the pixel circuit 5, the write transistor Tr1 is set to an OFF state by the write signal WS in a period of emission during which the organic EL device 8 is caused to emit light (FIG. 7A). In the pixel circuit 5, a power supply voltage Vcc is supplied to the driving transistor Tr2 by the driving signal DS for power supply in the period of emission (FIG. 7B). Accordingly, the pixel circuit 5 drives by current the organic EL device 8 by a driving current in accordance with an inter-terminal voltage of the holding capacity Cs to cause light emission in the period of emission.

In the pixel circuit 5, the driving signal DS for power supply is caused to fall to a predetermined fixed voltage Vss2 at time t0 when the period of emission ends (FIG. 7B). Here, the fixed voltage Vss2 is sufficiently low so that the drain of the driving transistor Tr2 can be caused to function as a source and is a voltage lower than the cathode voltage Vcath of the organic EL device 8.

Accordingly, in the pixel circuit 5, accumulated charges on the anode side of the organic EL device 8 flow out to the scanning line DSL via the driving transistor Tr2. As a result, in the pixel circuit 5, a source voltage Vs of the driving transistor Tr2 falls to the voltage Vss2 (FIG. 7E) and the organic EL device 8 stops emitting light. Also in the pixel circuit 5, a gate voltage Vg of the driving transistor Tr2 falls by operating together with the fall of the source voltage Vs (FIG. 7D).

In the pixel circuit 5, at a subsequent predetermined time t1, the write transistor Tr1 is changed to an ON state by the write signal WS (FIG. 7A) and the gate voltage Vg of the driving transistor Tr2 is set to the fixed voltage Vofs for threshold voltage correction set to the signal line DTL (FIGS. 7C and 7D). Accordingly, in the pixel circuit 5, the gate-source voltage Vgs of the driving transistor Tr2 is set to a voltage Vofs−Vss2. Here, in the pixel circuit 5, the voltage Vofs−Vss2 is set higher than a threshold voltage Vth of the driving transistor Tr2 based on settings of the voltages Vofs and Vss2.

Then, in the pixel circuit 5, at time t2, the drain voltage of the driving transistor Tr2 is caused to rise to the power supply voltage Vcc by the driving signal DS (FIG. 7B). Accordingly, in the pixel circuit 5, a charging current flows into the organic EL device 8 of the holding capacity Cs from the power supply Vcc via the driving transistor Tr2. As a result, in the pixel circuit 5, the voltage Vs on the side of the organic EL device 8 of the holding capacity Cs gradually rises. In this case, in the pixel circuit 5, the current flowing into the organic EL device 8 via the driving transistor Tr2 is used only for charging of the capacity Ce1 and the holding capacity Cs of the organic EL device 8. As a result, in the pixel circuit 5, only the source voltage Vs of the driving transistor Tr2 rises without the organic EL device 8 being caused to emit light.

Here, in the pixel circuit 5, when the inter-terminal voltage of the holding capacity Cs becomes equal to the threshold voltage Vth of the driving transistor Tr2, the inflow of the charging current via the driving transistor Tr2 stops. Therefore, in this case, the rise of the source voltage Vs of the driving transistor Tr2 stops when the potential difference between terminals of the holding capacity Cs becomes equal to the threshold voltage Vth of the driving transistor Tr2. Accordingly, the pixel circuit 5 causes the inter-terminal voltage of the holding capacity Cs to discharge via the driving transistor Tr2 to set the inter-terminal voltage of the holding capacity Cs to the threshold voltage Vth of the driving transistor Tr2.

In the pixel circuit 5, at time t3 after passage of sufficient time to set the inter-terminal voltage of the holding capacity Cs to the threshold voltage Vth of the driving transistor Tr2, the write transistor Tr1 is switched to an OFF state by the write signal WS (FIG. 7A). Subsequently, the voltage of the signal line DTL is set to the gradation setting voltage Vsig (=Vin+Vofs).

In the pixel circuit 5, at a subsequent time t4, the write transistor Tr1 is set to an ON state (FIG. 7A). Accordingly, in the pixel circuit 5, the gate voltage Vg of the driving transistor Tr2 is set to the gradation setting voltage Vsig and the gate-source voltage Vgs of the driving transistor Tr2 to a voltage obtained by adding the threshold voltage Vth of the driving transistor Tr2 to the gradation voltage Vin. Accordingly, the pixel circuit 5 can drive the organic EL device 8 by effectively avoiding fluctuations in the threshold voltage Vth of the driving transistor Tr2 so that quality deterioration due to fluctuations in luminance of emission of the organic EL device 8 can be prevented.

When the gate voltage Vg of the driving transistor Tr2 is set to the gradation setting voltage Vsig in the pixel circuit 5, the gate of the driving transistor Tr2 is connected to the signal line DTL for a fixed period Tμ while retaining the drain voltage of the driving transistor Tr2 at the power supply voltage Vcc. Accordingly, in the pixel circuit 5, fluctuations in mobility μ of the driving transistor Tr2 is also corrected.

That is, if the gate of the driving transistor Tr2 is connected to the signal line DTL by setting the write transistor Tr1 to an ON state while the inter-terminal voltage of the holding capacity Cs is set to the threshold voltage Vth of the driving transistor Tr2, the gate voltage Vg of the driving transistor Tr2 is set to the gradation setting voltage Vsig after gradually rising from the fixed voltage Vofs.

Here, in the pixel circuit 5, the write time constant necessary for the rise of the gate voltage Vg of the driving transistor Tr2 is set such that the write time constant becomes short as compared with the time constant necessary for the rise of the source voltage Vs by the driving transistor Tr2.

In this case, when the write transistor Tr1 is turned on, the gate voltage Vg of the driving transistor Tr2 will swiftly rise to the gradation setting voltage Vsig (Vofs+Vin). If the capacity Ce1 of the organic EL device 8 is sufficiently larger than the holding capacity Cs during the rise of the gate voltage Vg, the source voltage Vs of the driving transistor Tr2 will not fluctuate.

However, if the gate-source voltage Vgs of the driving transistor Tr2 increases over the threshold voltage Vth, a current flows in from the power supply Vcc via the driving transistor Tr2 so that the source voltage Vs of the driving transistor Tr2 gradually rises. As a result, in the pixel circuit 5, the inter-terminal voltage of the holding capacity Cs discharges through the driving transistor Tr2, lowering the rise speed of the gate-source voltage Vgs.

The discharging speed of the inter-terminal voltage changes depending on performance of the driving transistor Tr2. More specifically, the discharging speed increases with the increasing mobility μ of the driving transistor Tr2.

As a result, the pixel circuit 5 is set so that the inter-terminal voltage of the holding capacity Cs decreases with the increasing mobility μ of the driving transistor Tr2 to correct fluctuations in luminance of emission caused by fluctuations in mobility. In FIGS. 7A to 7E, the fall of the inter-terminal voltage according to corrections of the mobility μ is denoted by ΔV.

In the pixel circuit 5, when the correction period Tμ of mobility passes, the write signal WS is caused to fall at time t5. As a result, the pixel circuit 5 starts the period of emission and causes the organic EL device 8 to emit light by a driving current in accordance with the inter-terminal voltage of the holding capacity Cs. When the period of emission starts, the gate voltage Vg and the source voltage Vs of the driving transistor Tr2 rises due to a so-called bootstrap circuit in the pixel circuit 5.

With these operations, the pixel circuit 5 performs preparation of threshold voltage correction processing of the driving transistor Tr2 in the period between time t0 and time 2 in which the gate voltage of the driving transistor Tr2 is caused to fall to the voltage Vss2. In the subsequent period between time t2 and time t3 denoted by reference numeral Tth, the threshold voltage of the driving transistor Tr2 is corrected by setting the inter-terminal voltage of the holding capacity Cs to the threshold voltage Vth of the driving transistor Tr2. In the period Tμ between time t4 and time t5, the mobility of the driving transistor Tr2 is corrected and also the gradation setting voltage Vsig is sampled.

Thus, in the configuration in FIG. 6, the image display apparatus 1 sets the period of emission and the period of non-emission in which the organic EL device 8 is not caused to emit light by the driving signal DS for power supply. Therefore, the drive scan circuit 4B (FIG. 6) correspondingly outputs the drive signal DS by complementary ON/OFF control of a P-channel type transistor Tr3 and an N-channel type transistor Tr4 whose drain is connected to the predetermined voltages Vcc and Vss2. In FIG. 6, reference numeral 9 is an inverter that inputs a gate signal of the transistor Tr4 into the gate of the transistor Tr3 by inverting the gate signal.

For this type of image display apparatus, Japanese Patent Application Laid-Open No. 2007-133284 proposes a configuration in which processing to correct fluctuations in threshold voltage is performed by dividing the period Tth into a plurality of periods.

SUMMARY OF THE INVENTION

Incidentally, if the repetition frequency of a period of emission is low, flicker becomes visible in this type of image display apparatus. Thus, as shown in FIGS. 8A to 8E by being contrasted with FIGS. 7A to 7E, providing a pause in which light emission of the organic EL device 8 is temporarily halted by temporarily causing the driving signal DS for power supply to fall to the voltage Vss2 halfway through the period of emission can be considered. That is, in this case, the repetition frequency of the period of emission can be doubled so that flicker can be prevented.

However, in this case, there is a problem of deterioration of image quality in the image display apparatus due to a change of gate-source voltage of the driving transistor Tr2 held by the holding capacity Cs caused by a pause.

That is, in this case, the source voltage Vs of the driving transistor Tr2 falls to the voltage Vss2 of the driving signal DS for power supply in the pause and, in association with the fall, the gate voltage Vg falls to the voltage Vss2+Vgs. Vgs in this case is the gate-source voltage of the driving transistor Tr2 in the immediately preceding period of emission.

As a result, in the pixel circuit 5, the gate voltage Vg of the driving transistor Tr2 falls below the voltage of the write signal WS during the pause and a leak current arises via the write transistor Tr1 so that the gate voltage Vg of the driving transistor Tr2 changes. Accordingly, in the pixel circuit 5, the gate-source voltage Vgs of the driving transistor Tr2 changes in consecutive periods of emission sandwiching the pause therebetween, which leads to a change in luminance of emission of the organic EL device 8. In FIGS. 8A to 8E, a change in the gate voltage Vg in the pause is denoted by ΔVg.

Here, since the magnitude of the leak current changes in accordance with the voltage of the signal line DTL in the pause, a change in luminance of emission in consecutive periods of emission sandwiching the pause therebetween occurs in accordance with the luminance of emission of the other pixel circuits 5 connected to the same signal line DTL. As a result, shading, cross-talk and the like will occur in the image display apparatus, leading to deterioration of image quality.

As a method of solving this problem, further lowering the L level voltage of the write signal WS to prevent a leak current can be considered. However, in such a case, the amplitude of the write signal WS will exceed the limit of withstand voltage of the write transistor Tr1, making this method impracticable.

The present invention has been made in view of the above circumstances and proposes an image display apparatus capable of effectively avoiding deterioration of image quality in a configuration in which a pause is provided halfway through a period of emission and a method of driving the image display apparatus.

According to an embodiment of the present invention, there is provided an image display apparatus including a display unit in which pixel circuits are arranged in a matrix form, a signal line driving circuit that outputs a driving signal to a signal line provided in the display unit, and a scanning line driving circuit that outputs at least a driving signal for power supply and a write signal to a scanning line provided in the display unit, wherein the pixel circuit includes at least a light-emitting device, a driving transistor, to a drain of which the driving signal for power supply is applied to drive by current the light-emitting device by a driving current in accordance with a gate-source voltage, a holding capacity that holds the gate-source voltage, and a write transistor that connects a gate of the driving transistor to the signal line by the write signal to set a terminal voltage of the holding capacity to a voltage of the signal line, and alternately repeats a period of emission during which the light-emitting device is caused to emit light and a period of non-emission during which light emission by the light-emitting device is stopped, the period of emission has a pause during which light emission by the light-emitting device is temporarily stopped and which is provided halfway through the period, and the scanning line driving circuit causes the light-emitting device to stop light emission by setting the scanning line of the driving signal for power supply to a floating state at least in the pause.

According to an embodiment of the present invention, there is provided a method of driving an image display apparatus, wherein the image display apparatus includes a display unit in which pixel circuits are arranged in a matrix form, a signal line driving circuit that outputs a driving signal to a signal line provided in the display unit, and a scanning line driving circuit that outputs at least a driving signal for power supply and a write signal to a scanning line provided in the display unit, the pixel circuit includes at least a light-emitting device, a driving transistor, to a drain of which the driving signal for power supply is applied to drive by current the light-emitting device by a driving current in accordance with a gate-source voltage, a holding capacity that holds the gate-source voltage, and a write transistor that connects a gate of the driving transistor to the signal line by the write signal to set a terminal voltage of the holding capacity to a voltage of the signal line, and alternately repeats a period of emission during which the light-emitting device is caused to emit light and a period of non-emission during which light emission by the light-emitting device is stopped, the period of emission has a pause during which light emission by the light-emitting device is temporarily stopped which is provided halfway through the period, and the driving method includes the step of causing the light-emitting device to stop light emission by setting the scanning line of the driving signal for power supply to a floating state at least in the pause.

According to the configuration of an embodiment of the present invention, when a pause starts, the light-emitting device stops light emission by a discharge of accumulated charges due to the scanning line of the driving signal for power supply being set to a floating state, and the driving transistor side of the light-emitting device will be retained at a voltage when the light emission stops. Therefore, when compared with a case in which the inter-terminal voltage of the holding capacity is set to a voltage equal to or higher than the threshold voltage of driving transistor by causing the voltage on the light-emitting device side of the holding capacity to fall by causing the voltage of the driving signal for power supply to fall to the voltage on the side opposite to the driving transistor of the light-emitting device or lower, the source voltage of the driving transistor can be retained at a higher voltage during the pause. As a result, a leak current in the write transistor can be prevented and thus, image quality deterioration due to the leak current can be prevented.

According to the present invention, deterioration of image quality can effectively be avoided in a configuration in which a pause is provided halfway through a period of emission.

DETAILED DESCRIPTION OF THE EMBODIMENTS

Figures 1A, 1B, 1C, 1D, 1E, 1F, 1G, 1H:
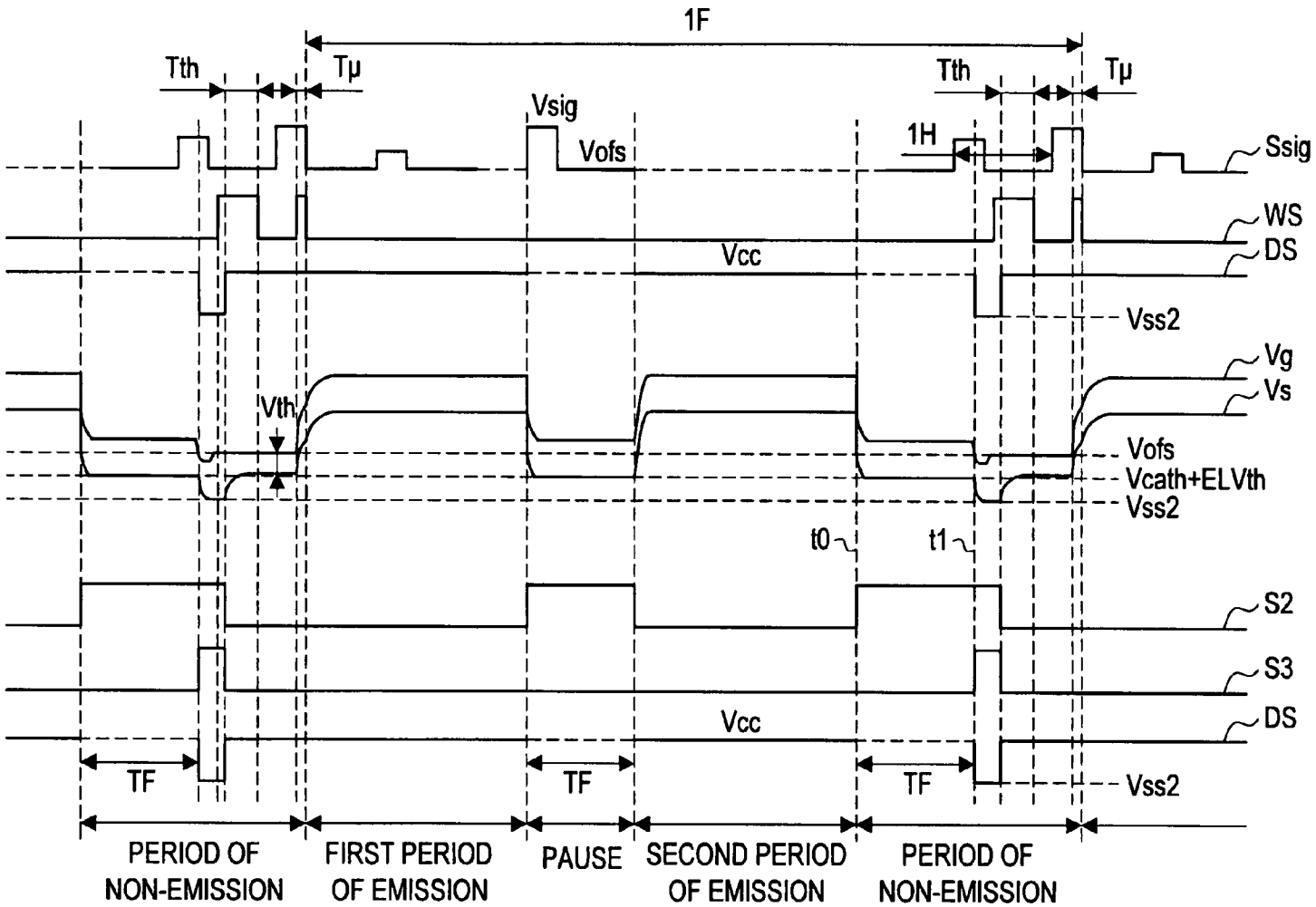
FIGS. 1A to 1H are time charts for explaining operations of an image display apparatus according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Embodiments of the present invention will be described in detail below with reference to the drawings when appropriate.

First Embodiment

(1) Configuration of the Embodiment

Figure 2:
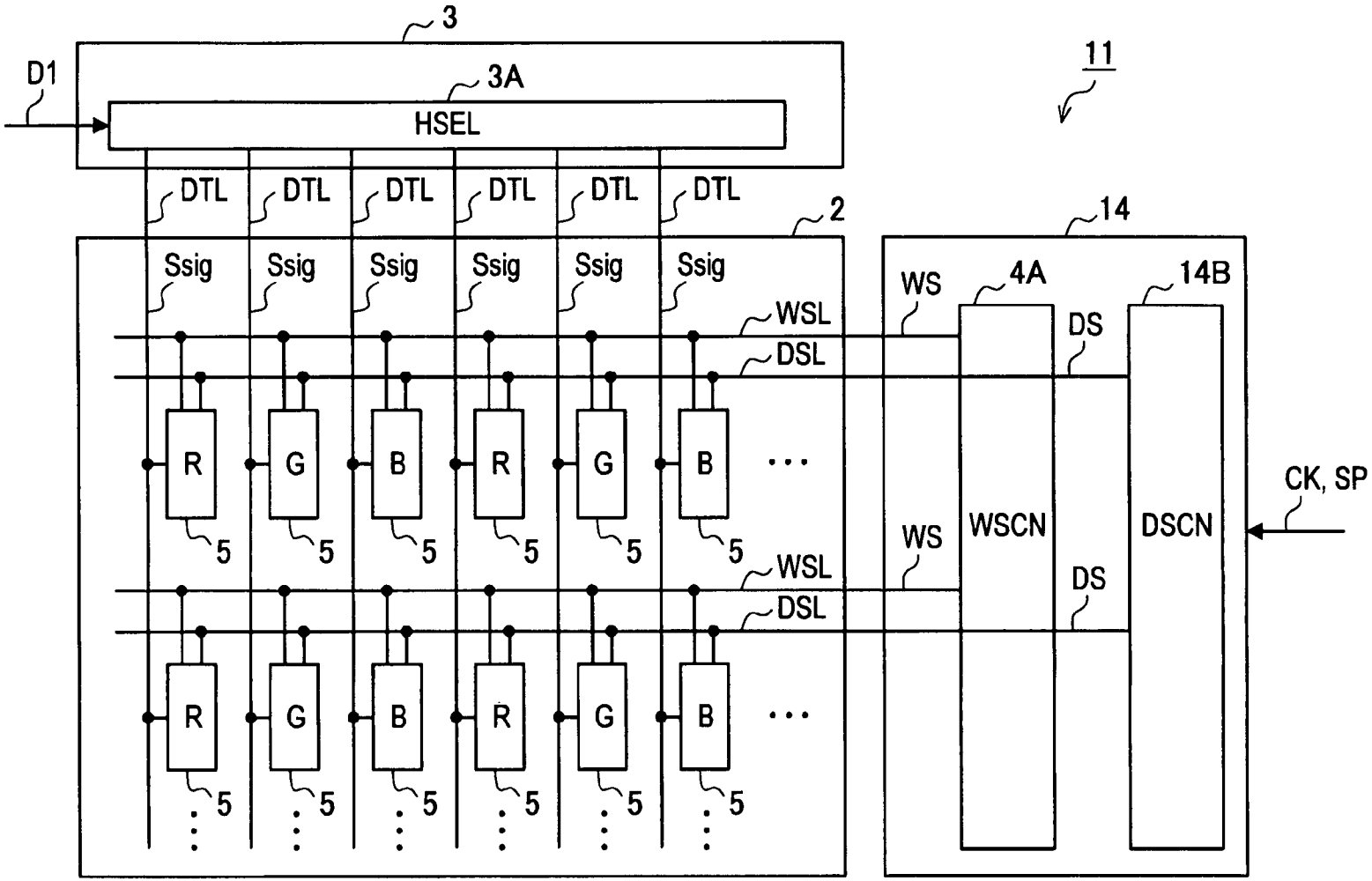
FIG. 2 is a block diagram showing the image display apparatus according to the first embodiment of the present invention.
Figure 3:
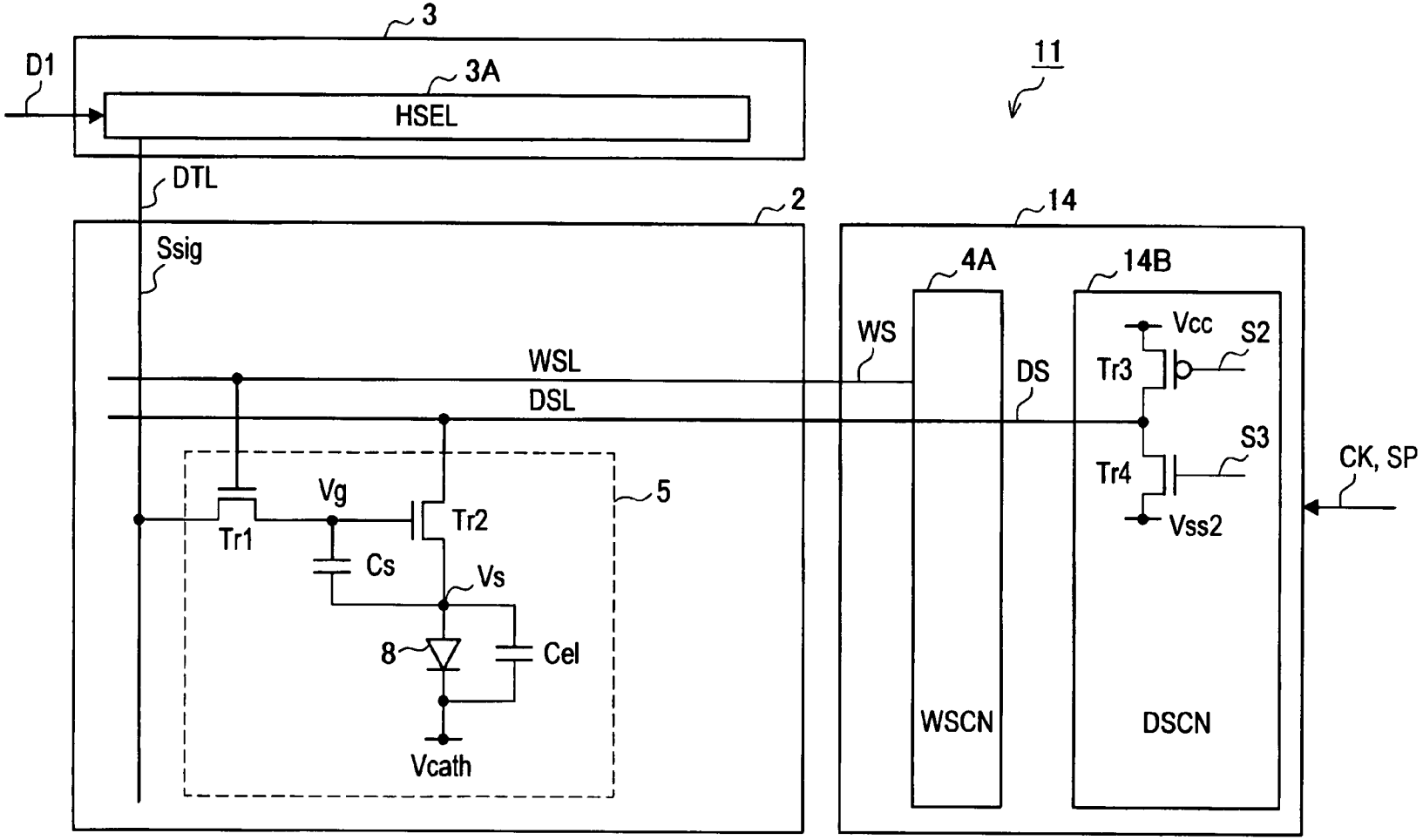
FIG. 3 is a block diagram showing the image display apparatus in FIG. 2 in detail.
Figures 4A, 4B, 4C, 4D, 4E:
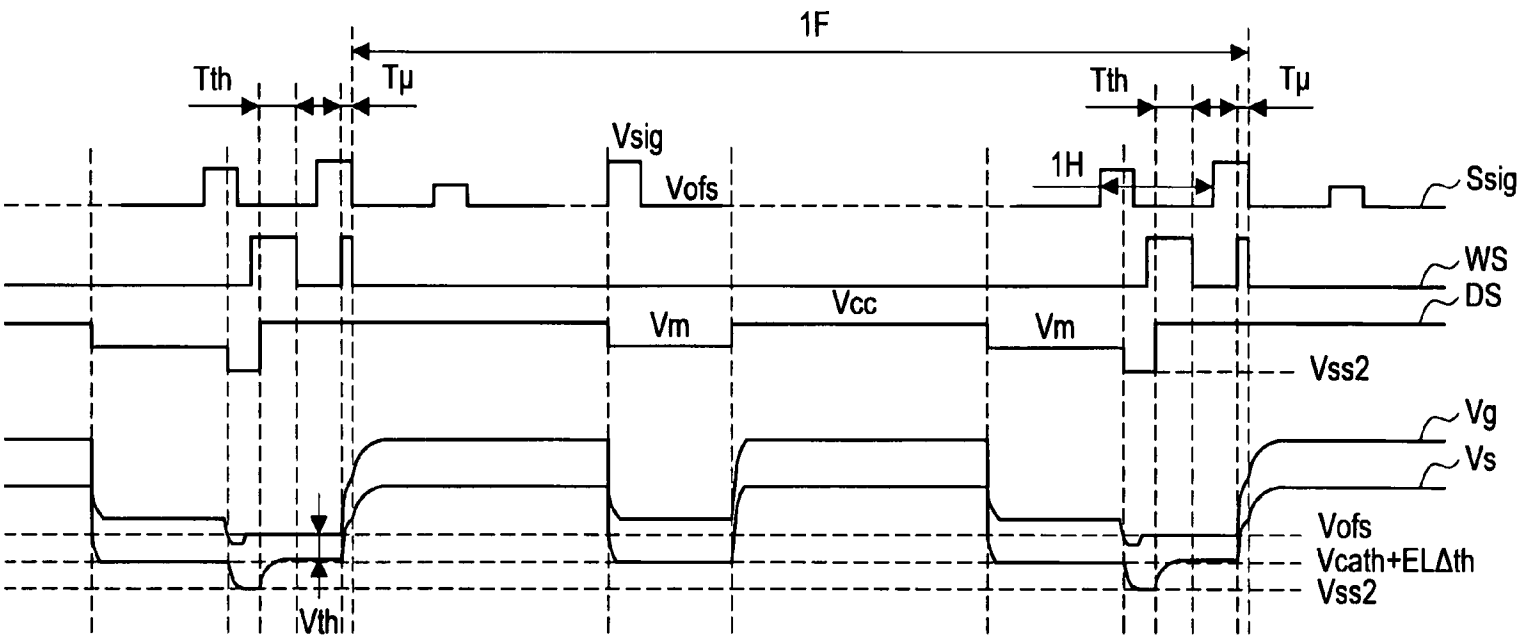
FIGS. 4A to 4E are time charts showing an operation example by voltage settings for a pause.
Figures 5A, 5B, 5C, 5D, 5E, 5F, 5G, 5H:
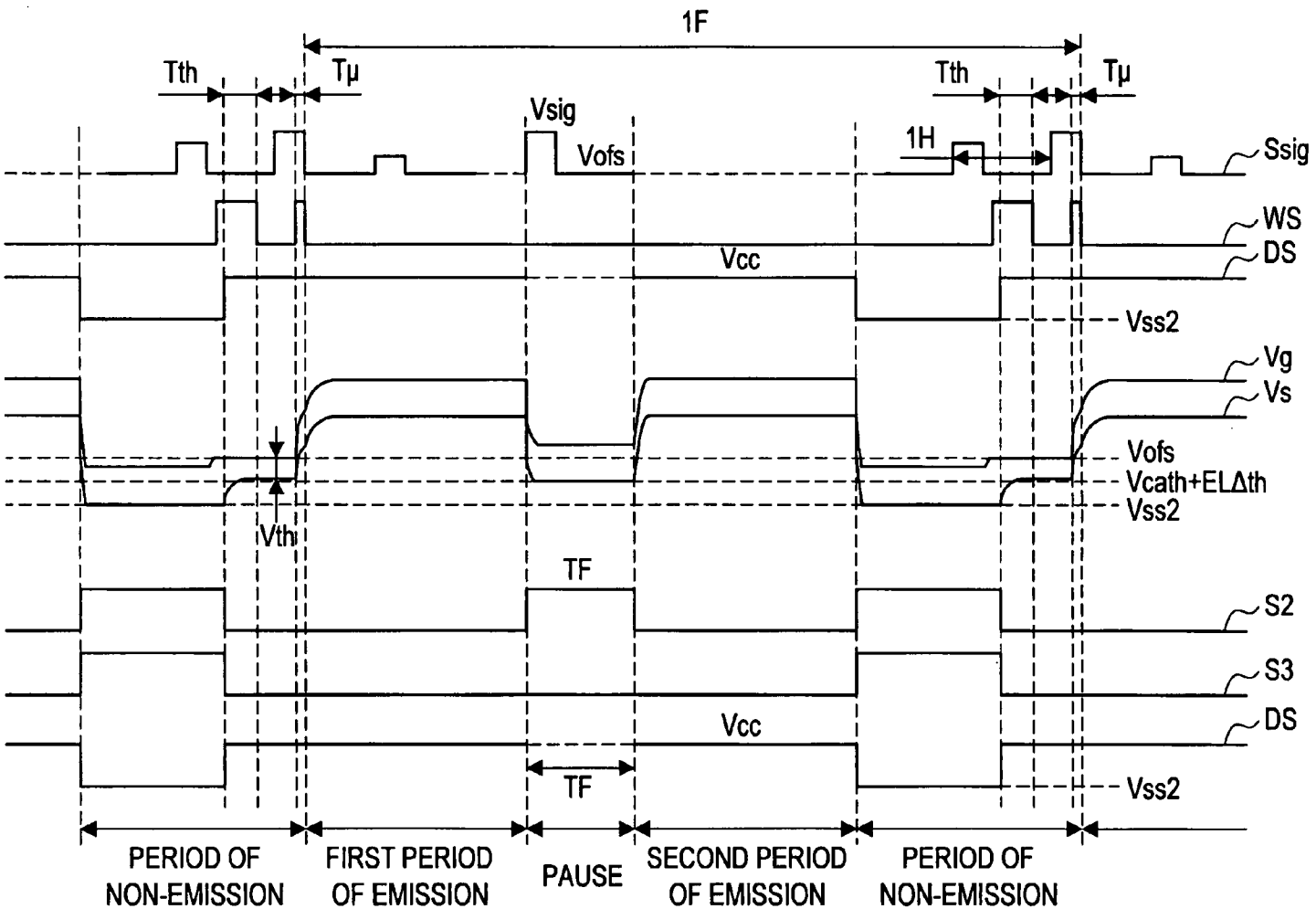
FIGS. 5A to 5H are time charts for explaining operations of an image display apparatus according to a second embodiment of the present invention.
Figure 6:
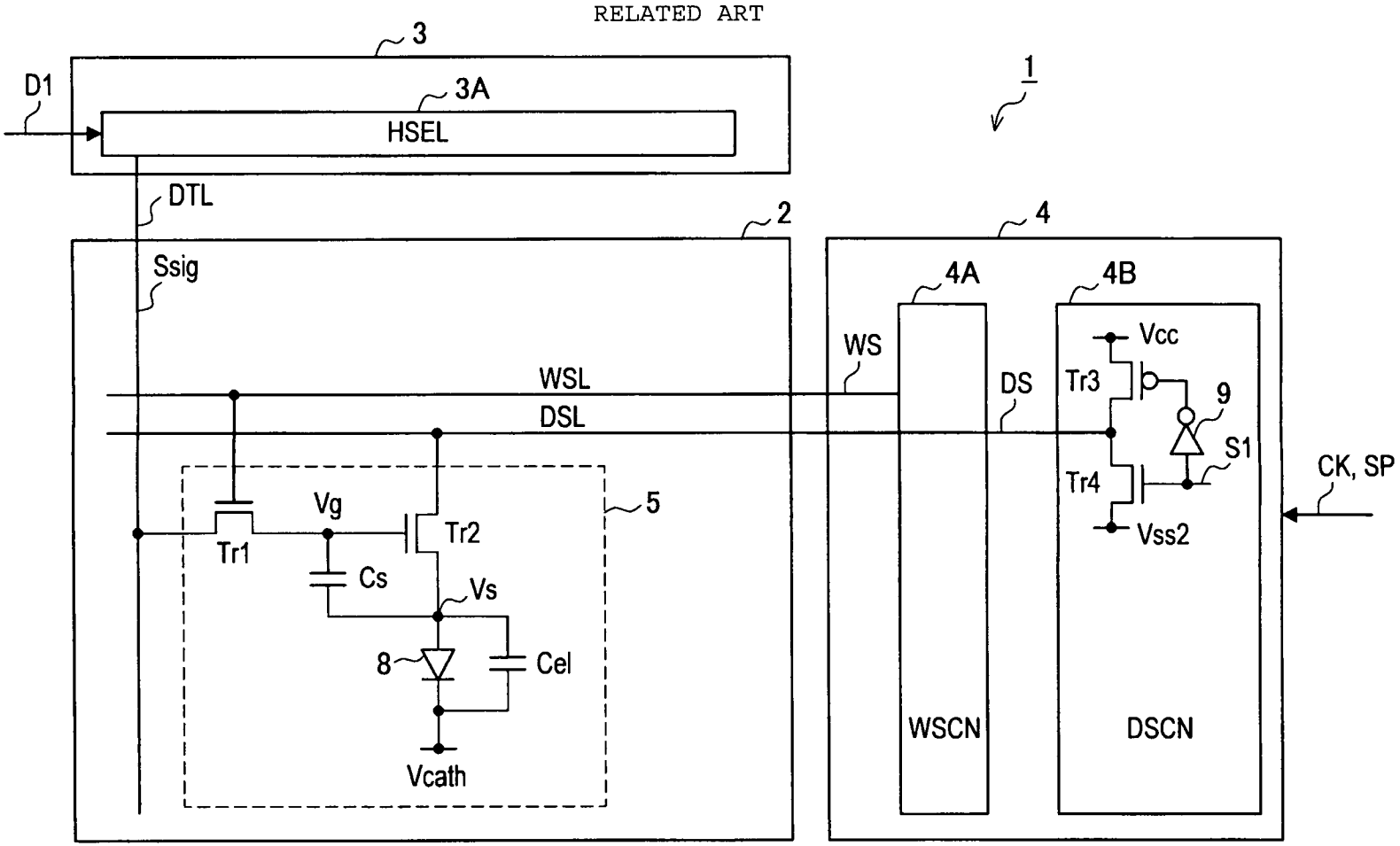
FIG.6 RELATED ART
FIG. 6 is a block diagram showing a conventional image display apparatus.
Figures 7A, 7B, 7C, 7D, 7E:
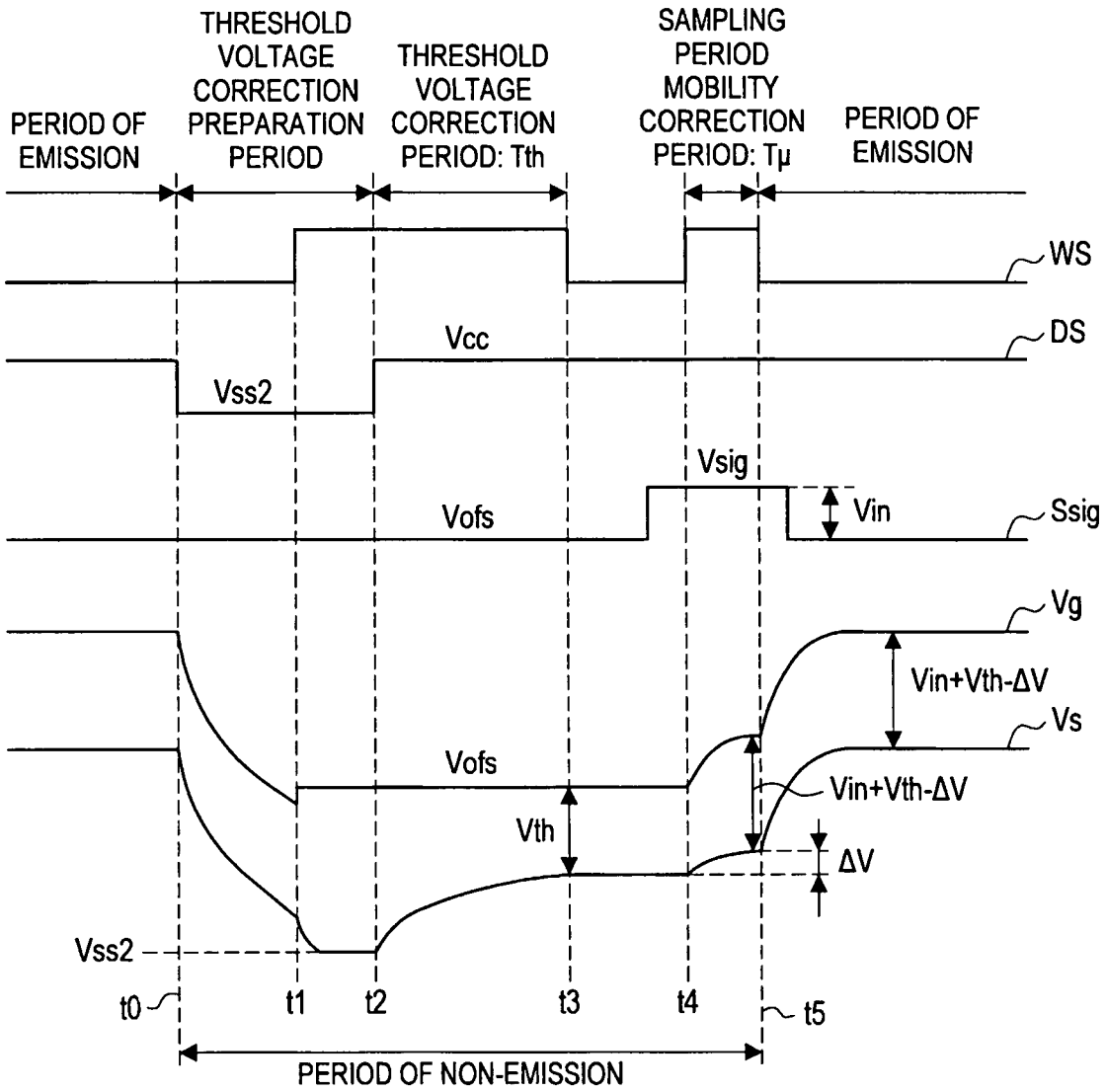
FIG.7A RELATED ART
FIG.7B RELATED ART
FIG.7C RELATED ART
FIG.7D RELATED ART
FIG.7E RELATED ART
FIGS. 7A to 7E are time charts for explaining operations of the image display apparatus in FIG. 6.
Figures 8A, 8B, 8C, 8D, 8E:
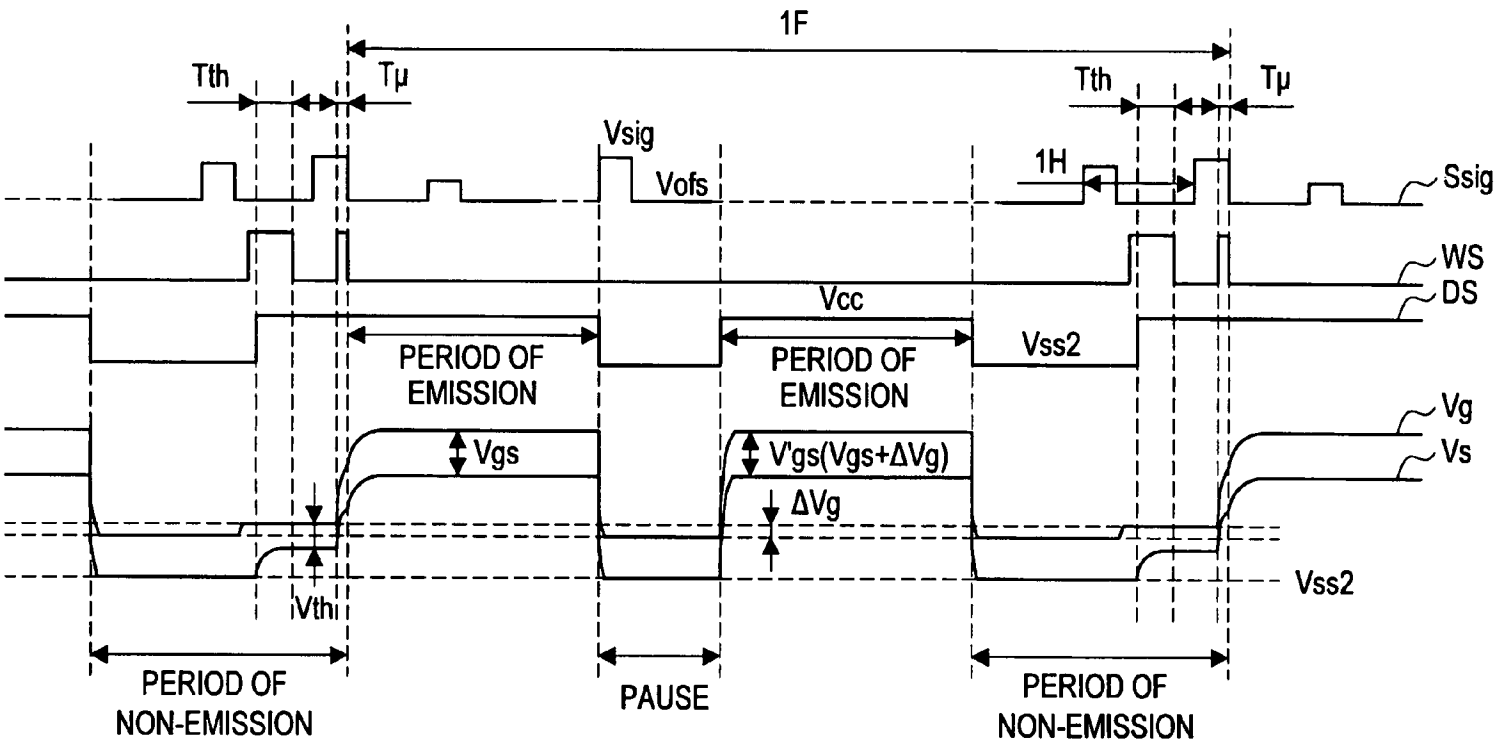
FIGS. 8A to 8E are time charts for explaining operations when a pause is provided in the image display apparatus in FIG. 6.

FIG. 2 is a block diagram showing an image display apparatus according to the first embodiment of the present invention. FIG. 3 is a block diagram showing an image display apparatus 11 in FIG. 2 by being contrasted with FIG. 6. The image display apparatus 11 is configured in the same manner as the image display apparatus 1 except that a scanning line driving circuit 14 is configured differently. The scanning line driving circuit 14 is configured in the same manner as the scanning line driving circuit 4 of the image display apparatus 1 except that a drive scan circuit (DSCN) 14B is configured differently. Therefore, in the image display apparatus 11, corresponding reference numerals are attached to the same components as those of the image display apparatus described above with reference to FIG. 6 to omit a duplicate description. In FIG. 2, the pixel circuits 5 provided with red, green, and blue color filters are denoted by reference numerals R, G, and B, respectively.

Here, in the drive scan circuit 14B (FIG. 3), the P-channel type transistor Tr3 and the N-channel type transistor Tr4 whose drains are connected to the power supplies Vcc and Vss2, respectively, are provided in the output stage of the driving signal DS to each scanning line DSL. The drive scan circuit 14B is connected to, in each output stage, the corresponding scanning line DSL to which sources of the transistors Tr3 and Tr4 are connected. The transistors Tr3 and Tr4 function as switch circuits in the drive scan circuit 14B and the transistors Tr3 and Tr4 are turned on selectively to set the driving signal DS to the voltages Vcc and Vss2, respectively. The drive scan circuit 14B also sets both the transistors Tr3 and Tr4 to an OFF state to set the scanning line DSL of the driving signal DS to a floating state.

The drive scan circuit 14B processes predetermined sampling pulses SP at the clock CK to generate control signals S2 and S3 for ON/OFF control of the transistors Tr3 and Tr4, after which these control signals S2 and S3 are input into the gates of the transistors Tr3 and Tr4, respectively.

Here, FIGS. 1A to 1H are time charts for explaining control of the transistors Tr3 and Tr4 by being contrasted with FIGS. 8A to 8E. In FIGS. 1A to 1H, the period during which the scanning line DSL of the driving signal DS is set to a floating state is denoted by reference numeral TF. The pixel circuit 5 is provided with a pause during which light emission of the organic EL device 8 is temporarily halted and a period of emission is formed by a first period of emission immediately before the pause and a second period of emission immediately after the pause.

In the first period of emission and the second period of emission, the pixel circuit 5 has the control signals S2 and S3 both set to the L level and the driving signal DS retained at the voltage Vcc (FIGS. 1F to 1H). Accordingly, the pixel circuit 5 drives the organic EL device 8 by a driving current in accordance with the gate-source voltage Vgs of the driving transistor Tr2 set for the holding capacity Cs during the period of emission to cause the organic EL device 8 to emit light with the luminance of emission in accordance with the gate-source voltage Vgs (FIGS. 1D and 1E).

In the pause, the pixel circuit 5 has the control signals S2 and S3 set to the H level and the L level, respectively, and the signal line DSL of the driving signal DS set to a floating state. Accordingly, when the pause starts, the supply of the power supply Vcc to the driving transistor Tr2 in the pixel circuit 5 is stopped so that the organic EL device 8 stops light emission.

More specifically, with the power supply Vcc stopped, a discharge of accumulated charges accumulated in the stray capacitance Ce1 of the organic EL device 8 via the organic EL device 8 starts and, as a result, the source voltage Vs of the driving transistor Tr2 gradually drops. When the inter-terminal voltage of the organic EL device 8 becomes equal to a threshold voltage ELVth of the organic EL device 8, the discharge stops to stop light emission of the organic EL device 8 (FIG. 1E).

As a result, when the pause starts, the pixel circuit 5 has the source voltage Vs of the driving transistor Tr2 lowered to and retained at a voltage Vcath+ELVth obtained by adding the threshold voltage ELVth of the organic EL device 8 to the cathode voltage Vcath of the organic EL device 8. The gate voltage Vg of the driving transistor Tr2 lowers in association with the lowering of the source voltage Vs and is lowered to and retained at a voltage Vgs+Vs (Vcath+ELVth) obtained by adding the source voltage Vs to the gate-source voltage Vgs of the driving transistor Tr2 in the immediately preceding first period of emission.

Accordingly, in the present embodiment, when compared with a case in which a pause is provided by setting the driving signal DS to the voltage Vss2 (FIGS. 8A to 8E), the gate voltage Vg of the driving transistor Tr2 during the pause can be retained at a higher voltage. As a result, the pixel circuit 5 can retain the write transistor Tr1 in an adequately cutoff state even if the display is black in which the gate voltage Vg becomes the lowest in the pause. Therefore, deterioration of image quality can effectively be avoided even if the repetition frequency of the period of emission is increased by providing a pause.

Further, when the period of non-emission starts at time t0, the pixel circuit 5 has the control signals S2 and S3 similarly set to the H level and the L level, respectively, and the signal line DSL of the driving signal DS set to a floating state in a fixed period up to time t1. Then, after the pixel circuit 5 has the control signals S2 and S3 both set to the H level and the driving signal DS fallen to the voltage Vss2 (FIGS. 1C, 1F to 1H), the write signal WS is caused to rise to set the gate voltage Vg of the driving transistor Tr2 to the voltage Vofs for threshold voltage correction (FIGS. 1A to 1E). Accordingly, the pixel circuit 5 has the inter-terminal voltage of the holding capacity Cs set to the voltage Vofs−Vss2 and makes preparations for processing to correct the threshold voltage of the driving transistor Tr2.

Subsequently, the pixel circuit 5 has the control signals S2 and S3 both set to the L level and the driving signal DS set to the voltage Vcc and starts the supply of power supply to the driving transistor Tr2 to correct the threshold voltage of the driving transistor Tr2. Also, mobility of the driving transistor Tr2 is corrected and the gradation setting voltage Vsig is sampled by the control of the write signal WS before starting the subsequent period of emission.

(2) Operations of the Embodiment

With the above configuration, after the image data D1 input sequentially is distributed to the signal line DTL of the display unit 2 in the signal line driving circuit 3 of the image display apparatus 11, digital/analog conversion processing is performed. Accordingly, in the image display apparatus 11, the gradation voltage Vin indicating the gradation of each pixel connected to the signal line DTL is created for each signal line DTL. In the image display apparatus 11, a voltage corresponding to the gradation voltage Vin is set to each of the pixel circuits 5 constituting the display unit 2 according to, for example, the line sequence by the display unit 2 being driven by the scanning line driving circuit 14. The organic EL device 8 in each of the pixel circuits 5 emits light based on luminance of emission in accordance with the gradation voltage Vin (FIGS. 7A to 7E). Accordingly, in the image display apparatus 11, an image in accordance with the image data D1 can be displayed in the display unit 2.

More specifically, in the pixel circuit 5, the organic EL device 8 is driven by current by the driving transistor Tr2 in the source follower circuit configuration. In the pixel circuit 5, the voltage on the gate side of the holding capacity Cs provided between the gate and source of the driving transistor Tr2 is set to the voltage Vsig in accordance with the gradation voltage Vin. Accordingly, in the image display apparatus 11, a desired image is displayed by causing the organic EL device 8 to emit light based on luminance of emission in accordance with the image data D1.

However, the driving transistor Tr2 applied to the pixel circuit 5 has a disadvantage that fluctuations in the threshold voltage Vth are great. As a result, if the voltage on the gate side of the holding capacity Cs is simply set to the voltage Vsig in accordance with the gradation voltage Vin in the image display apparatus 11, the luminance of emission of the organic EL device 8 fluctuates because the threshold voltage Vth of the driving transistor Tr2 fluctuates, which leads to deterioration of image quality.

Thus, in the image display apparatus 11, after the voltage on the side of the organic EL device 8 of the holding capacity Cs is caused to fall, the gate voltage of the driving transistor Tr2 is set to the fixed voltage Vofs for threshold voltage correction via the write transistor Tr1 by causing the driving signal Ds to fall to the voltage Vss2 enough to cause the source of the driving transistor Tr2 to function as a drain. Accordingly, in the image display apparatus 11, the inter-terminal voltage of the holding capacity Cs is set to the threshold voltage Vth of the driving transistor Tr2 or higher. Then, the driving signal DS is caused to rise to the voltage Vcc, and the inter-terminal voltage of the holding capacity Cs is caused to discharge via the driving transistor Tr2. With the sequence of processing, the inter-terminal voltage of the holding capacity Cs is set to the threshold voltage Vth of the driving transistor Tr2 in advance in the image display apparatus 11.

Then, in the image display apparatus 11, the gradation setting voltage Vsig obtained by adding the fixed voltage Vofs to the gradation voltage Vin is set to the gate voltage of the driving transistor Tr2. Accordingly, in the image display apparatus 11, image quality deterioration due to fluctuations in the threshold voltage Vth of the driving transistor Tr2 can be prevented.

Image quality deterioration due to fluctuations in mobility of the driving transistor Tr2 can be prevented by retaining the gate voltage of the driving transistor Tr2 at the gradation setting voltage Vsig while power supply Vcc is supplied to the driving transistor Tr2 for a fixed period Tμ.

However, if the organic EL device 8 is caused to emit light in the period of emission by setting the gradation for each of the pixel circuits 5 in this manner, there is a possibility that flicker becomes visible. In such a case, flicker can be made invisible by providing a pause during which light emission of the organic EL device 8 is temporarily stopped to double the repetition frequency in the period of emission.

However, if a pause is provided by setting the driving signal DS to the voltage Vss2 for the period of non-emission, the gate voltage Vg of the driving transistor Tr2 drops more than necessary. As a result, a leak current arises in the write transistor Tr1 of the pixel circuit 5, which changes the inter-terminal voltage of the holding capacity Cs during the pause. Accordingly, in this case, shading, cross-talk and the like will occur, leading to deterioration of image quality.

As a method of solving this problem, further lowering the L level voltage of the write signal WS involved in control of the write transistor Tr1 to prevent a leak current can be considered. However, in such a case, the amplitude of the write signal WS will exceed the limit of withstand voltage of the write transistor Tr1, making this method impracticable.

Thus, in the present embodiment, the scanning line DSL for power supply is retained in a floating state during the pause by controlling the transistors Tr3 and Tr4 provided in the drive scan circuit 14B. In this case, since the supply of the power supply Vcc to the driving transistor Tr2 is stopped in the pixel circuit 5, charges accumulated in the organic EL device 8 are discharged via the organic EL device 8, gradually lowering the source voltage Vs of the driving transistor Tr2.

When the inter-terminal voltage of the organic EL device 8 becomes equal to the threshold voltage of the organic EL device 8, the discharge via the organic EL device 8 stops so that the source voltage Vs of the driving transistor Tr2 will be retained at a fixed voltage.

As a result, in the present embodiment, when compared with a case of causing the driving signal DS to fall to the voltage Vss2, the source voltage Vs of the driving transistor Tr2 can be retained at a higher voltage during the pause and correspondingly, the excessive drop of the gate voltage Vg of the driving transistor Tr2 can be prevented. Accordingly, in the present embodiment, a leak current of the write transistor Tr1 during the pause can be prevented so that image quality deterioration can be prevented by preventing fluctuations in inter-terminal voltage of the holding capacity Cs during the pause.

Incidentally, instead of retaining the scanning line DSL in a floating state in this manner, a method of setting the voltage of the driving signal DS in such a way that the gate voltage of the driving transistor Tr2 is set to a floating state can be considered. More specifically, as shown in FIGS. 4A to 4E by being contrasted with FIGS. 1A to 1H, this is a method that sets the driving signal DS to a voltage Vm that is higher than the voltage Vss2 and equal to or lower than a voltage obtained by adding the threshold voltage of the organic EL device 8 to the cathode voltage Vcath of the organic EL device 8. In this case, the excessive drop of the gate voltage Vg of the driving transistor Tr2 can similarly be prevented during the pause.

However, according to this method, it is necessary to provide a power supply of the voltage Vm in the drive scan circuit 14B and it is also necessary to provide a transistor to selectively output the voltage Vm for each scanning line DSL and a control circuit to control the transistor. Therefore, the configuration of the scanning line driving circuit becomes more complex when compared with a conventional one.

However, according to the present embodiment, deterioration of image quality can be prevented by preventing flicker with a simple configuration of only changing control of the output stage in the drive scan circuit 14B. Therefore, the configuration of modules constituting a scanning line driving circuit can be made simpler and further, the image display apparatus 11 can be made a narrower frame.

Further in the present embodiment, the inter-terminal voltage of the holding capacity Cs is set to a voltage equal to or lower than the threshold voltage Vth of the driving transistor Tr2 also in the period of non-emission by first setting the scanning line DSL of the driving signal DS to a floating state to stop light emission of the organic EL device 8 and then, causing the driving signal DS to fall to the voltage Vss2. Then, the inter-terminal voltage of the holding capacity Cs is set to the threshold voltage Vth of the driving transistor Tr2 by a discharge via the driving transistor Tr2.

Accordingly, in the present embodiment, when compared with a case of starting the period of non-emission by directly causing the driving signal DS to fall to the voltage Vss2, loads on the power supply Vss2 can be reduced. Therefore, in the present embodiment, the configuration of the drive scan circuit 14B can be further simplified by making effective use of the configuration related to the pause and further, power consumption can be reduced.

(3) Effects of the Embodiment

According to the above configuration, deterioration of image quality can effectively be avoided in a configuration in which a pause is provided halfway through a period of emission by retaining a scanning line for power supply in a floating state in the pause provided halfway through the period of emission.

The configuration can be further simplified by making effective use of the configuration related to the pause by setting the inter-terminal voltage of holding capacity to a voltage equal to or higher than the threshold voltage of the driving transistor by causing the driving signal for power supply to fall after the scanning line for power supply is set to a floating state and further, power consumption can be reduced.

Deterioration of image quality can effectively be avoided by alternately outputting a voltage for threshold voltage correction and a voltage corresponding to the gradation of a light-emitting device to the signal line, setting the terminal voltage of holding capacity to the voltage for threshold voltage correction via the write transistor, and setting the inter-terminal voltage of holding capacity to a voltage equal to or higher than the threshold voltage of the driving transistor to apply a configuration that creates a pixel circuit by two transistors and to provide a pause.

Second Embodiment

FIGS. 5A to 5H are time charts for explaining an image display apparatus in the second embodiment of the present invention by being contrasted with FIGS. 1A to 1H. The image display apparatus in the present embodiment retains the scanning line DSL of the driving signal DS in a floating state only in a pause.

According to the present embodiment, the same effect as that in the first embodiment can be achieved by setting the scanning line of the driving signal DS to a floating state only in a pause.

Third Embodiment

In the above embodiments, cases have been described in which the inter-terminal voltage of holding capacity is set to a voltage equal to or higher than the threshold voltage of the driving transistor by setting the terminal voltage of holding capacity to the fixed voltage Vofs for threshold voltage correction via a signal line. However, the present invention is not limited to such cases and may be widely applied when, for example, a transistor is separately provided and the terminal voltage of holding capacity is set to the fixed voltage Vofs for threshold voltage correction by ON/OFF control of the transistor.

Also in the above embodiments, cases in which a pause is provided for the purpose of preventing flicker have been described, but the present invention is not limited to such cases and may be widely applied when, for example, a pause is provided for the purpose of making various corrections.

Also in the above embodiments, cases in which processing to set the inter-terminal voltage of holding capacity to the threshold voltage of the driving transistor by a discharge via the driving transistor in one period have been described, but the present invention is not limited to such cases and the processing may be performed in a plurality of periods.

Also in the above embodiments, cases in which an N-channel type transistor is applied as a driving transistor have been described, but the present invention is not limited to such cases and may be widely applied to an image display apparatus or the like in which P-channel type transistors are applied as driving transistors.

Also in the above embodiments, cases in which the present invention is applied to an image display apparatus of organic EL devices have been described, but the present invention is not limited to such cases and may be widely applied to image display apparatuses of various current-driven self-luminous devices.

It should be understood by those skilled in the art that various modifications, combinations, sub-combinations and alterations may occur depending on design requirements and other factors insofar as they are within the scope of the appended claims or the equivalents thereof.

The present application contains subject matter related to that disclosed in Japanese Priority Patent Application JP 2008-277899 filed in the Japan Patent Office on 29 Oct. 2008, the entire content of which is hereby incorporated by reference.

The present invention relates to an image display apparatus and a method of driving the image display apparatus and can be applied to, for example, an active matrix image display apparatus using organic EL devices.

What is claimed is:

1. An image display apparatus comprising: a display unit in which pixel circuits are arranged in a matrix form; a signal line driving circuit that outputs a driving signal to a signal line provided in the display unit; and a scanning line driving circuit that outputs at least a driving signal for power supply and a write signal to a scanning line provided in the display unit, wherein the pixel circuit includes at least: a light-emitting device; a driving transistor, to a drain of which the driving signal for power supply is applied to drive by current the light-emitting device by a driving current in accordance with a gate-source voltage; a holding capacity that holds the gate-source voltage; and a write transistor that connects a gate of the driving transistor to the signal line by the write signal to set a terminal voltage of the holding capacity to a voltage of the signal line, and alternately repeats an emission period during which the light-emitting device is caused to emit light and a non-emission period during which light emission by the light-emitting device is stopped, wherein within a given frame, the emission period has a pause during which light emission by the light-emitting device is temporarily stopped, the pause being provided within a middle portion of the emission period for the given frame, and the scanning line driving circuit causes the light-emitting device to stop light emission for the pause by setting the scanning line of the driving signal for power supply to a floating state.

2. The image display apparatus according to claim 1, wherein the signal line driving circuit and the scanning line driving circuit, in the non-emission period and after an inter-terminal voltage of the holding capacity is set to a voltage equal to or higher than a threshold voltage of the driving transistor by causing the voltage on a side of the light-emitting device of the holding capacity to fall by causing the voltage of the driving signal for power supply to fall to a voltage equal to or lower than the voltage on the side opposite to the driving transistor of the light-emitting device, discharge the inter-terminal voltage of the holding capacity via the driving transistor by causing the voltage of the driving signal for power supply to rise to set the inter-terminal voltage of the holding capacity to the threshold voltage of the driving transistor, and then set the terminal voltage of the holding capacity to the voltage of the signal line via the write transistor to set a gradation of the light-emitting device for a subsequent emission period, and in the emission period, cause the light-emitting device to emit light by supplying a power supply to the driving transistor by the driving signal for power supply.

3. The image display apparatus according to claim 2, wherein the scanning line driving circuit causes the voltage of the driving signal for power supply to fall to a voltage equal to or lower than the voltage on the side opposite to the driving transistor of the light-emitting device after light emission of the light-emitting device is stopped by setting the scanning line of the driving signal for power supply to the floating state.

4. The image display apparatus according to claim 2, wherein the signal line driving circuit alternately outputs a voltage for correcting the threshold voltage of the driving transistor and a voltage corresponding to the gradation of the light-emitting device, and the scanning line driving circuit sets the inter-terminal voltage of the holding capacity to a voltage equal to or higher than the threshold voltage of the driving transistor by setting the terminal voltage of the holding capacity to the voltage for correcting the threshold voltage via the write transistor.

5. A method of driving an image display apparatus, the image display apparatus comprising a display unit in which pixel circuits are arranged in a matrix form, a signal line driving circuit that outputs a driving signal to a signal line provided in the display unit, and a scanning line driving circuit that outputs at least a driving signal for power supply and a write signal to a scanning line provided in the display unit; and the pixel circuit including a light-emitting device, a driving transistor, to a drain of which the driving signal for power supply is applied to drive by current the light-emitting device by a driving current in accordance with a gate-source voltage, a holding capacity that holds the gate-source voltage, and a write transistor that connects a gate of the driving transistor to the signal line by the write signal to set a terminal voltage of the holding capacity to a voltage of the signal line, and the method comprising: alternately repeating an emission period during which the light-emitting device is caused to emit light and a non-emission period during which light emission by the light-emitting device is stopped, wherein within a given frame, the emission period has a pause during which light emission by the light-emitting device is temporarily stopped, the pause being provided within a middle portion of the emission period for the given frame, and causing the light-emitting device to stop light emission for the pause by setting the scanning line of the driving signal for power supply to a floating state.

6. The method according to claim 5, further comprising:

in the emission period and after an inter-terminal voltage of the holding capacity is set to a voltage equal to or higher than a threshold voltage of the driving transistor by causing the voltage on a side of the light-emitting device of the holding capacity to fall by causing the voltage of the driving signal for power supply to fall to a voltage equal to or lower than the voltage on the side opposite to the driving transistor of the light-emitting device, discharging the inter-terminal voltage of the holding capacity via the driving transistor by causing the voltage of the driving signal for power supply to rise to set the inter-terminal voltage of the holding capacity to the threshold voltage of the driving transistor, and then setting the terminal voltage of the holding capacity to the voltage of the signal line via the write transistor to set a gradation of the light-emitting device for a subsequent emission period, and in the emission period, causing the light-emitting device to emit light by supplying a power supply to the driving transistor by the driving signal for power supply.

7. The method according to claim 6, wherein the scanning line driving circuit causes the voltage of the driving signal for power supply to fall to a voltage equal to or lower than the voltage on the side opposite to the driving transistor of the light-emitting device after light emission of the light-emitting device is stopped by setting the scanning line of the driving signal for power supply to the floating state.

8. The method according to claim 6, further comprising:

alternately outputting, by the signal line driving circuit, a voltage for correcting the threshold voltage of the driving transistor and a voltage corresponding to the gradation of the light-emitting device; and setting, by the scanning line driving circuit, the inter-terminal voltage of the holding capacity to a voltage equal to or higher than the threshold voltage of the driving transistor by setting the terminal voltage of the holding capacity to the voltage for correcting the threshold voltage via the write transistor.

9. An image display apparatus comprising: a display unit in which pixel circuits are arranged in a matrix form; a signal line driving circuit that outputs an image signal to a signal line of the display unit; and a driving circuit for outputting a power supply signal to a power supply scanning line of the display unit and a write signal to a write scanning line of the display unit, wherein the pixel circuit includes at least: a light-emitting device; a driving transistor, having a drain to which the power supply signal is applied to drive the light-emitting device according to a gate-source voltage of the driving transistor; a holding capacity that holds the gate-source voltage; and a write transistor that connects a gate of the driving transistor to the signal line to set a terminal voltage of the holding capacity to a voltage of the signal line corresponding to the image signal, wherein an emission period during which the light-emitting device is caused to emit light and a non-emission period during which light emission by the light-emitting device is stopped are alternately repeated, the emission period corresponding to a given frame of the image signal, the emission period has a pause during which light emission by the light-emitting device is temporarily stopped, the pause being provided within a middle portion of the emission period, and the driving circuit causes the light-emitting device to stop light emission by setting the power supply scanning line to a floating state during the pause.

10. The apparatus according to claim 1, wherein the pause is provided at a halfway point of the emission period.

11. The method according to claim 5, wherein the pause is provided at a halfway point of the emission period.

12. The apparatus according to claim 9, wherein the pause is provided at a halfway point of the emission period.

* * * * *